US007568896B2

(12) United States Patent
Dooley

(10) Patent No.: US 7,568,896 B2
(45) **Date of Patent: *Aug. 4, 2009**

(54) PUMP AND METHOD

(75) Inventor: Kevin Allan Dooley, Mississauga (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/564,937

(22) Filed: Nov. 30, 2006

(65) Prior Publication Data

US 2007/0092382 A1 Apr. 26, 2007

Related U.S. Application Data

(63) Continuation of application No. 11/017,797, filed on Dec. 22, 2004, now Pat. No. 7,226,277.

(51) Int. Cl.
*F04B 35/04* (2006.01)
*F04D 3/02* (2006.01)

(52) U.S. Cl. ..... 417/356; 417/355; 417/423.7; 417/423.12; 415/71; 415/72; 415/110; 415/111

(58) Field of Classification Search ..... 417/356, 417/355; 415/72, 75, 110, 11; 416/176, 416/177

See application file for complete search history.

(56) References Cited

U.S. PATENT DOCUMENTS

| | | | | |
|---|---|---|---|---|
| 2,225,338 | A | 12/1940 | Giess | |
| 2,500,400 | A | 3/1950 | Cogswell | |
| 2,953,993 | A | 9/1960 | Strickland et al. | |
| 3,220,350 | A | 11/1965 | White | |
| 3,288,073 | A | 11/1966 | Pezzillo | |
| 3,373,690 | A | 3/1968 | Unger | |
| 3,413,925 | A | 12/1968 | Campolong | |
| 3,697,190 | A | 10/1972 | Haentjens | |
| 3,972,653 | A | 8/1976 | Travis et al. | |
| 3,986,551 | A | 10/1976 | Kilpatrick | |
| 4,382,199 | A * | 5/1983 | Isaacson | 310/87 |
| 4,408,966 | A | 10/1983 | Maruyama | |
| 4,415,308 | A | 11/1983 | Maruyama et al. | |
| 4,470,752 | A | 9/1984 | Teruo et al. | |
| 4,957,504 | A * | 9/1990 | Chardack | 623/3.14 |
| 5,049,134 | A | 9/1991 | Golding et al. | |
| 5,088,899 | A | 2/1992 | Blecker et al. | |
| 5,505,594 | A | 4/1996 | Sheehan | |
| 5,692,882 | A | 12/1997 | Bozeman, Jr. et al. | |
| 6,068,454 | A | 5/2000 | Gaston et al. | |
| 6,368,075 | B1 * | 4/2002 | Fremerey | 417/365 |

(Continued)

OTHER PUBLICATIONS

International Search Report—Issued by the Canadian Intellectual Property Office as the International Searching Authority on Feb. 23, 2006, for the PCT International Application corresponding to and claiming priority from the U.S. Appl. No. 11/017,797.

*Primary Examiner*—Charles G Freay
*Assistant Examiner*—Patrick Hamo
(74) *Attorney, Agent, or Firm*—Ogilvy Renualt LLP

(57) ABSTRACT

A pump for moving a liquid including a stator and a rotor which rotates to move at least one helical pumping member. The rotor in rotation is radially supported relative to the stator only by a layer of liquid maintained between the rotor and stator by rotor rotation.

6 Claims, 6 Drawing Sheets

U.S. PATENT DOCUMENTS 6,450,785 B1 9/2002 Delby et al.
6,692,225 B2 2/2004 Lin
7,226,277 B2 * 6/2007 Dooley ..... 417/356
2004/0241019 A1 12/2004 Goldowsky

* cited by examiner

PUMP AND METHOD

CROSS-REFERENCE TO RELATED APPLICATIONS

This is a Continuation of Applicant's U.S. patent application Ser. No. 11/017,797, filed on Dec. 22, 2004 now U.S. Pat. No. 7,226,277.

FIELD OF THE INVENTION

The present invention relates to a pump used for pumping a liquid.

BACKGROUND OF THE INVENTION

Electrically driven helix-type pumps are known. Permanent magnet pumps are also known. For example, a centrifugal blood pump is disclosed in U.S. Pat. No. 5,049,134 and an axial blood pump is disclosed in U.S. Pat. No. 5,692,882. In general, these and other helix pumps rely on friction or fluid dynamic lift to move fluid axially though the pump. That is, although the helix rotates, the liquid is rotationally relatively stationary as it moves axially along the length of the pump. While perhaps suited for pumping blood and other low speed and low pressure application, these devices are unsuitable for other environments, particularly where high speed and high pressures are desired. Room for improvement is therefore available.

SUMMARY OF THE INVENTION

One object of the present invention is to provide an improved pump.

In accordance with one aspect of the present invention, there is provided a pump having at least one inlet and one outlet for use in a liquid circulation system, the liquid having a dynamic viscosity, the circulation system in use having a back pressure at the pump outlet, the pump comprising a rotary rotor and a stator providing first and second spaced-apart surfaces defining a generally annular passage therebetween, the passage having a central axis and a clearance height, the clearance height being a radial distance from the first surface to the second surface, the rotor in use adapted to rotate at a rotor speed, at least one thread mounted to the first surface and extending helically around the central axis at a thread angle relative to the central axis, the thread having a height above the first surface and a thread width, the thread height less than the clearance height, the thread width together with a thread length providing a thread surface area opposing the second surface, wherein the rotor, in use, rotates at a rotor speed relative to the stator which results in a viscous drag force opposing rotor rotation, said drag force caused by shearing in the liquid between the thread and first surface and the second surface, the viscous drag force having a corresponding viscous drag pressure, wherein the thread height, thread surface area and thread angle are adapted through their sizes and configurations to provide a viscous drag pressure substantially equal to the back pressure, and wherein the clearance height is sized to provide for a non-turbulent liquid flow between the first and second surfaces.

In another aspect, the present invention provides a method of sizing a pumping system, the system including at least one pump and a circulation network for circulating a liquid having a dynamic viscosity, the circulation system having a back pressure at an outlet of the pump, the pump having a rotary rotor and a stator providing first and second spaced-apart surfaces defining a generally annular passage therebetween, the passage having a central axis and a clearance height, the clearance height being a radial distance from the first surface to the second surface, the rotor in use adapted to rotate at a rotor speed, at least one thread mounted to the first surface and extending helically around the central axis at a thread angle relative to the central axis, the thread having a height above the first surface and a thread width, the method comprising the steps of determining the back pressure for a desired system configuration and a given liquid, dimensioning pump parameters so as to provide a non-turbulent flow in the passage during pump operation, selecting thread dimensions to provide a drag pressure in response to rotor rotation during pump operation, and adjusting at least one of back pressure and a thread dimension to substantially equalize drag pressure and back pressure for a desired rotor speed during pump operation.

In another aspect, the present invention provides a pump for a liquid, the pump comprising a stator including at least one electric winding adapted, in use, to generate a rotating electromagnetic field, a rotor mounted adjacent the stator for rotation in response to the rotating electromagnetic field, the rotor and stator providing first and second spaced-apart surfaces defining a pumping passage therebetween; and at least one helical thread disposed between the first and second surfaces and mounted to one of said surfaces, the thread having a rounded surface facing the other of said surfaces, wherein the rotor is sized relative to a selected working liquid such that, in use, the rotating rotor is radially supported relative to the stator substantially only by a layer of the liquid maintained between the rotor and stator by rotor rotation. Preferably rotor position is radially maintained substantially by a layer of the liquid between the rounded surface and the other of said surfaces which it faces.

In another aspect, the present invention provides a pump comprising a housing and a rotor rotatable relative to the housing, the rotor and housing defining at least a first flow path for a pump fluid, the rotor being axially slidable relative to the housing between a first position and a second position, the first position corresponding to a rotor axial position during normal pump operation, the second position corresponding to a rotor axial position during a pump inoperative condition, the rotor in the second position providing a second flow path for the fluid, the second flow path causing a reduced fluid pressure drop relative to the first flow path when the pump is in the inoperative condition. Preferably the second flow path is at least partially provided through the rotor. Preferably the first flow path is provided around the rotor.

In another aspect, the present invention provides a method of making a pump, comprising the steps of providing a housing, rotor, and at least one wire, winding the wire helically onto the rotor to provide a pumping member on the rotor, and fixing the wire to the rotor.

In another aspect, the present invention provides a pump for pumping a liquid, the pump comprising a rotor, and a stator, the stator including at least one electrical winding at least one cooling passage, and a working conduit extending from a pump inlet to a pump outlet, working conduit in liquid communication with the cooling passage at at least a cooling passage inlet, such that in use a portion of the pumped liquid circulates through the cooling passage.

In another aspect, the present invention provides a pump comprising a rotor and working passage through which fluid is pumped and at least one feedback passage, the feedback passage providing fluid communication between a high pressure region of the pump to an inlet region of the pump. Preferably the feedback passage is provided through the rotor.

In another aspect, the present invention provides a pump comprising a rotor working passage through which liquid is pumped and at least one feedback passage, the rotor being disposed in the working passage and axially slidable relative thereto, the working passage including a thrust surface against which the rotor is thrust during pump operation, the feedback passage providing liquid communication between a high pressure region of the working passage and the thrust surface such that, in use, a portion of the pressurized liquid is delivered to form a layer of liquid between the rotor and thrust surface.

In another aspect, the present invention provides an anti-icing system comprising a pump and a circulation network, wherein the pump is configured to generate heat in operation as a result of viscous shear in the pump liquid, the heat being sufficient to provide a pre-selected anti-icing heat load to the liquid.

Other advantages and features of the present invention will be disclosed with reference to the description and drawings.

BRIEF DESCRIPTION OF THE DRAWINGS

Reference will be now made to the accompanying drawings in which.

DETAILED DESCRIPTION OF THE PREFERRED EMBODIMENTS

Figure 1:
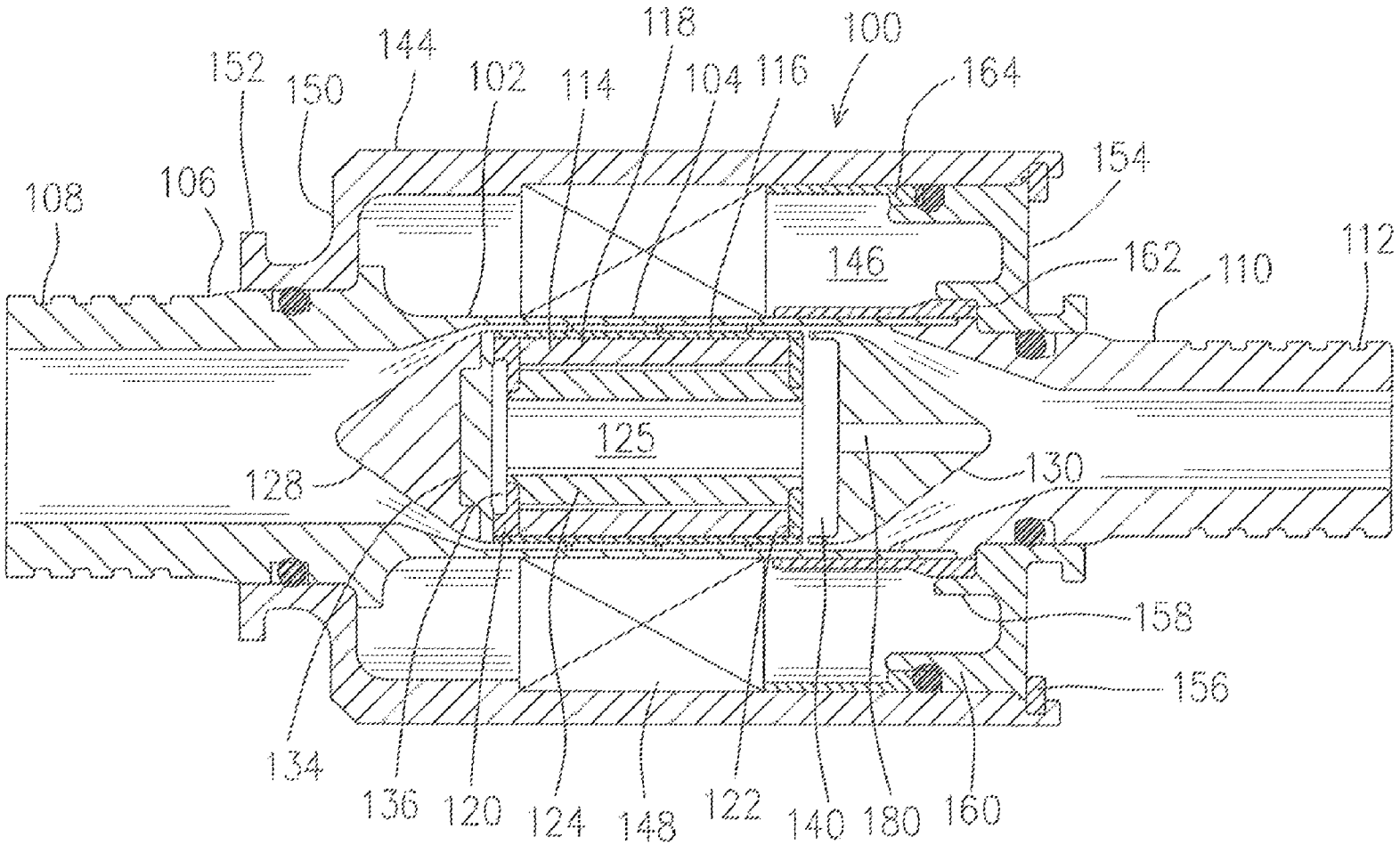
FIG. 1 is a cross-sectional view of a helix pump incorporating one embodiment of the present invention.
Figure 2:
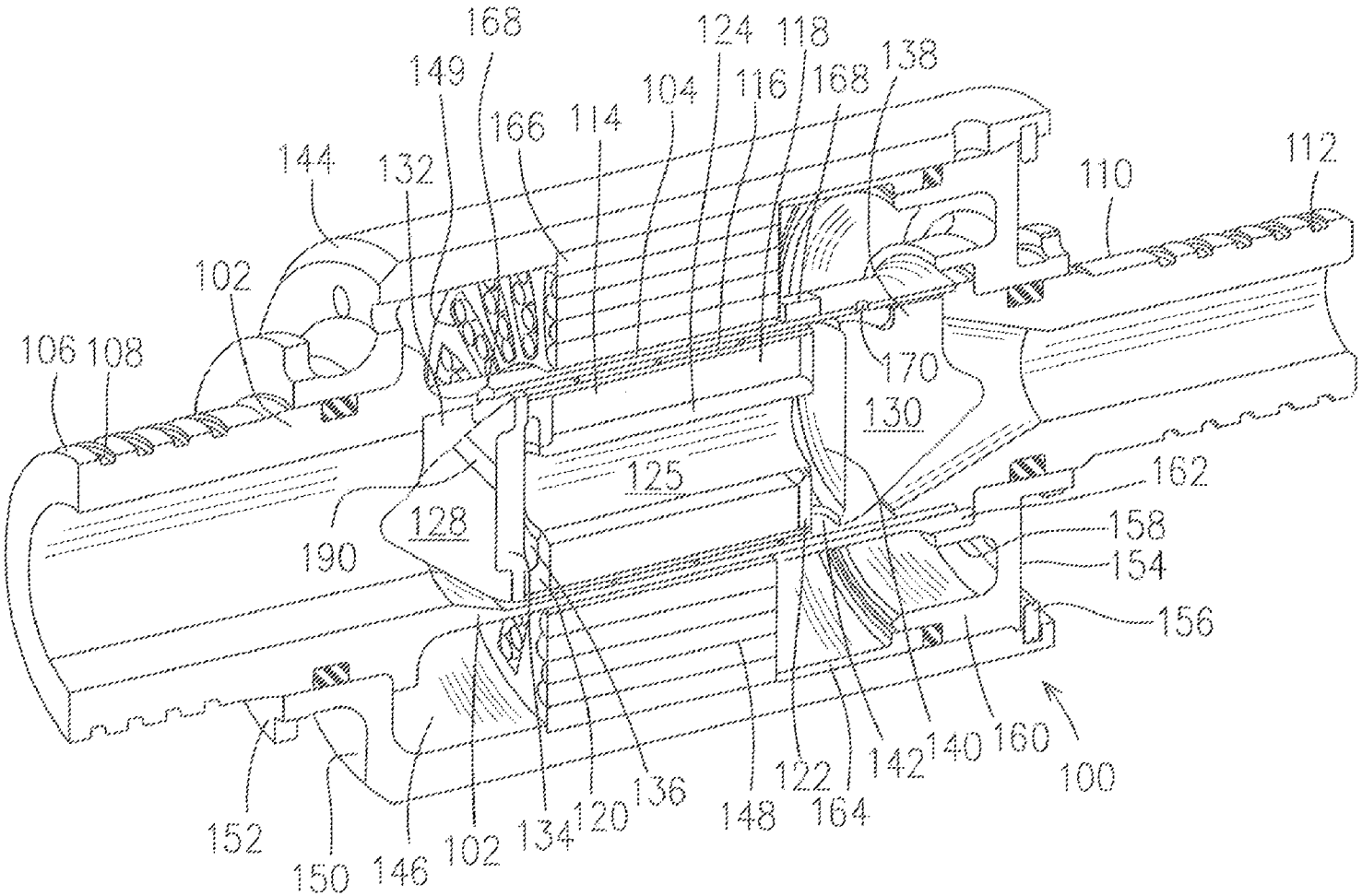
FIG. 2 is an isometric view of the embodiment of FIG. 1.
Figure 4:
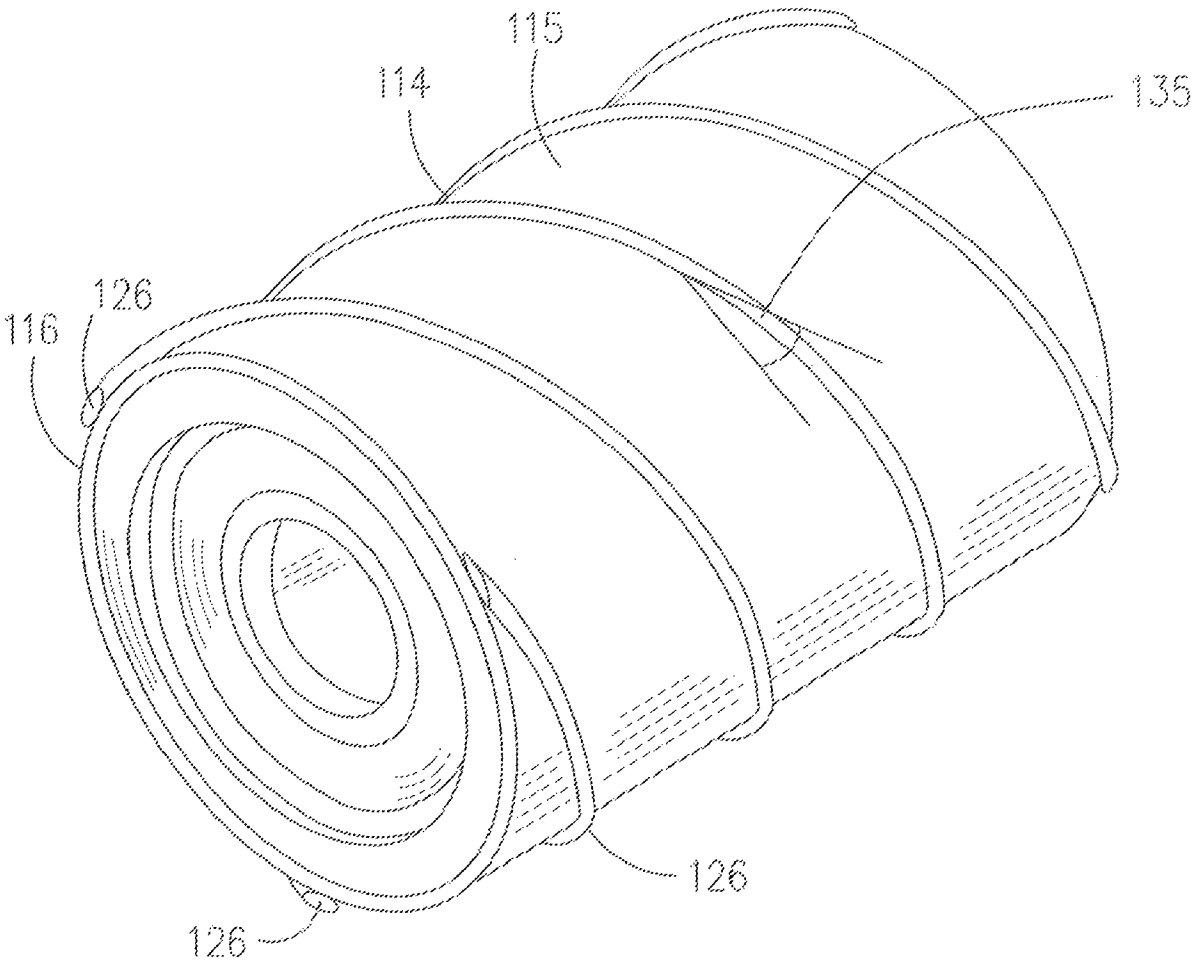
FIG. 4 is an isometric view of the rotor of FIG. 1.

Referring to FIGS. 1, 2 and 4, a helix pump, generally indicated at numeral 100, is provided according to one preferred embodiment of the present invention.

The helix pump 100 includes a cylindrical housing 102 having at one end a working conduit 104, a pump inlet 106, and pump outlet 110. The housing 102, or at least the working conduit 104 are made of non-metal material, for example, a plastic, ceramic or other electrically non-conductive material, so that eddy currents are not induced by the alternating magnetic field of the stator and rotor system. Preferably, in addition to being non-conductive, the inner wall of conduit 104 is smooth, and not laminated, to thereby provide sealing capability and low friction with the rotor, as will be described further below. Connection means, such as a plurality of annular grooves 108, are provided on pump inlet 106 for connection with an oil source such as an oil tank (not shown). The end of the working conduit 104 abuts a shoulder (not indicated) of a pump outlet 110 which preferably is positioned co-axially with the housing 102. The pump outlet 110 is also provided with connection means, such as a plurality of annual grooves 112 for connection to an oil circuit, including, for example, engine parts for lubrication, cooling, etc. Any suitable connection means, such as flanged connection, or force-fit connection, etc. may be used. Alternately, where the pump inlet and/or outlet is in direct contact with the working fluid (e.g. if the pump is submerged in a working fluid reservoir, for example), the inlet and/or outlet may have a different suitable arrangement.

A rotor 114 (cylindrical in this embodiment) is positioned within the working conduit 104, and includes a preferably relatively thin retaining sleeve 116, preferably made of a non-magnetic metal material, such as Inconel 718 (registered trade mark of for Inco Limited), titanium or certain non-magnetic stainless steels. The rotor 114 further includes at least one, but preferably a plurality of, permanent magnet(s) 118 within the sleeve 116 in a manner so as to provide a permanent magnet rotor suitable for use in a permanent magnet electrical motor. The permanent magnets 118 are preferably retained within the sleeve 116 by a pair of non-magnetic end plates 120, 122 and an inner magnetic metal sleeve 124. A central passage 125 preferably axially extends through the rotor 114. The rotor 114 is adapted for rotation within the working conduit 104. The rotor 114 external diameter is sized such that a sufficiently close relationship (discussed below) is defined between the external surface 115 of the rotor 115 and the internal surface (not indicated) of the working conduit 104, which permits a layer of working fluid (in this case oil) in the clearance between the rotor and the conduit. As will be described further below, the clearance is preferably sized to provide a non-turbulent flow, and more preferably, to provide a substantially laminar flow in the pump. As will also be discussed further below, this is because the primary pumping effect of the invention is achieved through the application of a viscous shear force by thread 123 on the working fluid, which is reacted by the rotor 114 to move the working fluid tangentially and axially through the pump.

Figure 3B:
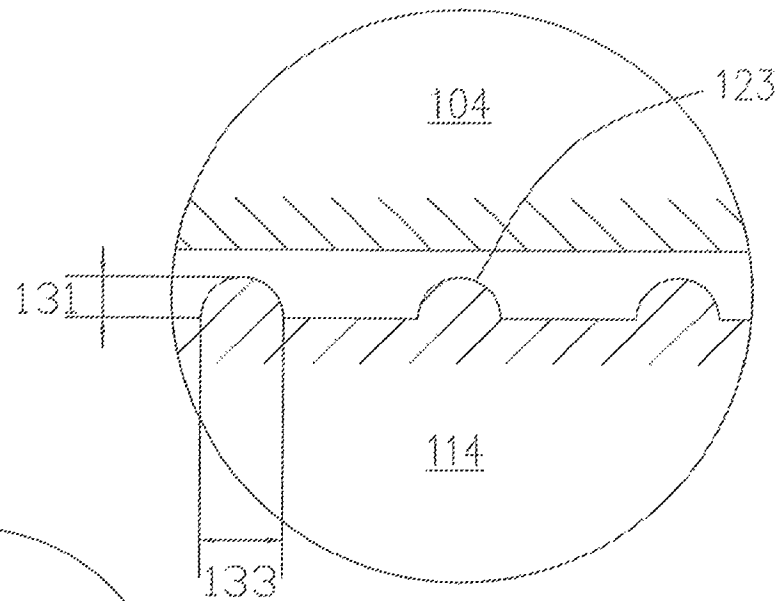
FIG. 3B is similar to FIG. 3A showing an another embodiment.
Figure 3C:
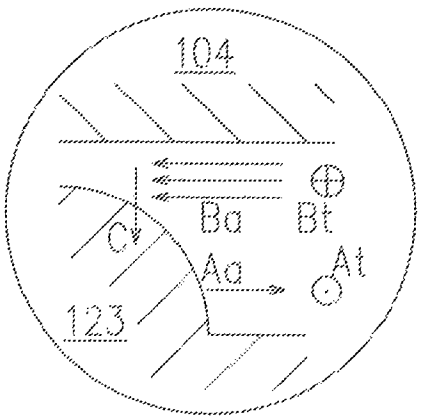
FIG. 3C is a further enlarged portion of FIG. 3A, schematically showing some motions and forces involved.
Figure 3A:
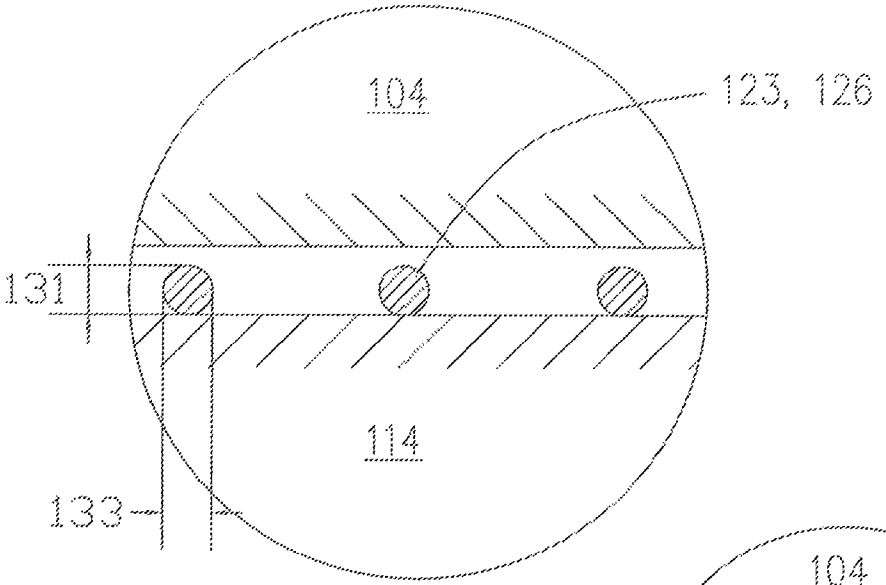
FIG. 3A is an enlarged portion of FIG. 1.

Referring to FIGS. 3A and 4, in this embodiment three threads 123 are provided, in this embodiment in the form of wires 126, each having a thread height 131, a thread width 133 a thread length (not indicated), and preferably a rounded outer surface or land 127, for reasons explained further below, such as that which is provided by the use of circular cross-sectioned wires 126. A thread surface area (not indicated), being the thread length times the thread width 133, represents the portion of the thread which is exposed directly to conduit 104, the significance of which will be discussed further below. The wires 126 may be made of any suitable material, such as metal or carbon fibre, nylon, etc. The wires 126 are preferably mounted about the external surface of the rotor 114 in a helix pattern, having a helix or thread angle 135, and circumferentially spaced apart from each other 120°. When rotated, the rotor 114 is dynamically radially supported within conduit 104 substantially only by a layer of the oil (the working fluid, in this example) between the rounded outer surface 127 of the thread 123 and the inner surface of the working conduit 104, as described further below. Rounded surface 127 preferably has a radius of about 0.008" or greater, but depends on pump size, speed, working liquid, etc. The threads 123, the outer surface of rotor 114 and the inner surface of working conduit 104 together define a plurality of oil passages which are preferably relatively shallow and wide. These shallow and wide oil passages provide for a thin layer of working fluid between rotor and conduit.

In accordance with the present invention, the number and configuration of the helical thread(s) 123 is/are not limited to the wires 126 described above, but rather any other suitable type and configuration of helical thread(s) may be used. For example, referring to FIG. 3B, a more fastener-like thread 123 may be provide in the form of ridge 129, having a rounded surface 127, on the operative surface of the rotor. Alternately, a thread 123 may be formed and then mounted to the rotor in a suitable manner. Any other suitable configuration may also be used.

Where the helical thread(s) are not integral with the rotor, they are preferably sealed to the rotor 114 to reduce leakage therebetween. For example, for wires 126 sealing is provided by welding or brazing, however other embodiments may employ an interference fit, other mechanical joints (e.g. adhesive or interlocking fit), friction fit, or other means to provide fixing and sealing. It will be understood that the mounting means and sealing means may vary, depend on the materials and configurations involved. Where extensible thread(s) are employed, such as wires 126, it is preferable to pre-tension it/them to also help secure position and reduce unwanted movement.

Axial translation of the cylindrical rotor 114 within conduit 104 is limited by an inlet core member 128 and the outlet core member 130, but rotor 114 is otherwise preferably axially displaceable therebetween (i.e. rotor 114 is axially shorter than the space available), as will be described further below. The non-rotating inlet core member 128 preferably has a conical shape for dividing and directing an oil inflow from the pump inlet 106 towards the space between the rotor 114 and the working conduit 104, and is preferably generally co-axially positioned within the housing 102 and mounted adjacent thereto by a plurality (preferably three) of generally radial struts 132 (only one of which is shown in FIG. 2). The struts 132 are circumferentially spaced apart to allow the oil to flow therepast and may also act as inlet guide vanes. The inlet core member 128 includes end plate 134 mounted adjacent the inner side thereof, forming an inlet end wall for contacting the end plate 120 of the rotor 114. The end plate 120 of the rotor 114 preferably has a central recess 136 to reduce the contacting area with the end plate 134, but perhaps more importantly, in use the recess 136 is allowed to fill with pressurized oil via the central passage 125, which helps balance the forces acting on rotor 114 and thereby reduce the axial load on the rotor 114 during the pump operation. End plate 134 and rotor 114 are configured to allow sufficient leakage therebetween, such that pressurized oil from central passage 125 may support rotor 114 in use in a manner similar to a thrust bearing. The struts 132 supporting the inlet core member 128 can also have a plurality of fluid supply passages 190 provided such that small jets of fluid may be directed from the pressurized liquid in central passage 125 (which has entered passage 125 through holes 142, described further below) toward the inlet end of the pump through the supporting struts 132, to promote an inlet fluid flow to the inlet of the pump, thereby improving the inlet conditions. Passages 125 and 190 thus provide a pressure feedback system.

Similar to the inlet core member 128, the non-rotating outlet core member 130 preferably has a conical shape for directing and rejoining the flow of oil from the space between the rotor 114 and the working conduit 104 into the pump outlet 110, and is preferably positioned generally co-axially with the housing 102 and the outlet 110. The outlet core member 130 is mounted adjacent the outlet 110 by a plurality (preferably three) of struts 138 (only one is shown in FIG. 2) which are circumferentially spaced apart to permit pumped oil to flow therepast. The outlet core member 130 also has a central recess 140 and a plurality of openings 142 (see FIG. 2) to provide fluid communication between the central recess 140 and the working conduit 104, for bypass purposes to be explained further below. The outlet core member 130 may also have a central hole 180 to provide an escape route or bleed for air or other gases that may otherwise be collected by centrifugal separation in the pumped fluid. In an alternate configuration (not shown) a conduit may also or instead be provided to evacuate the separated gas/air which collects at this location, and/or in other locations where separated gas/air may collect depending on pump configuration.

Figure 5:
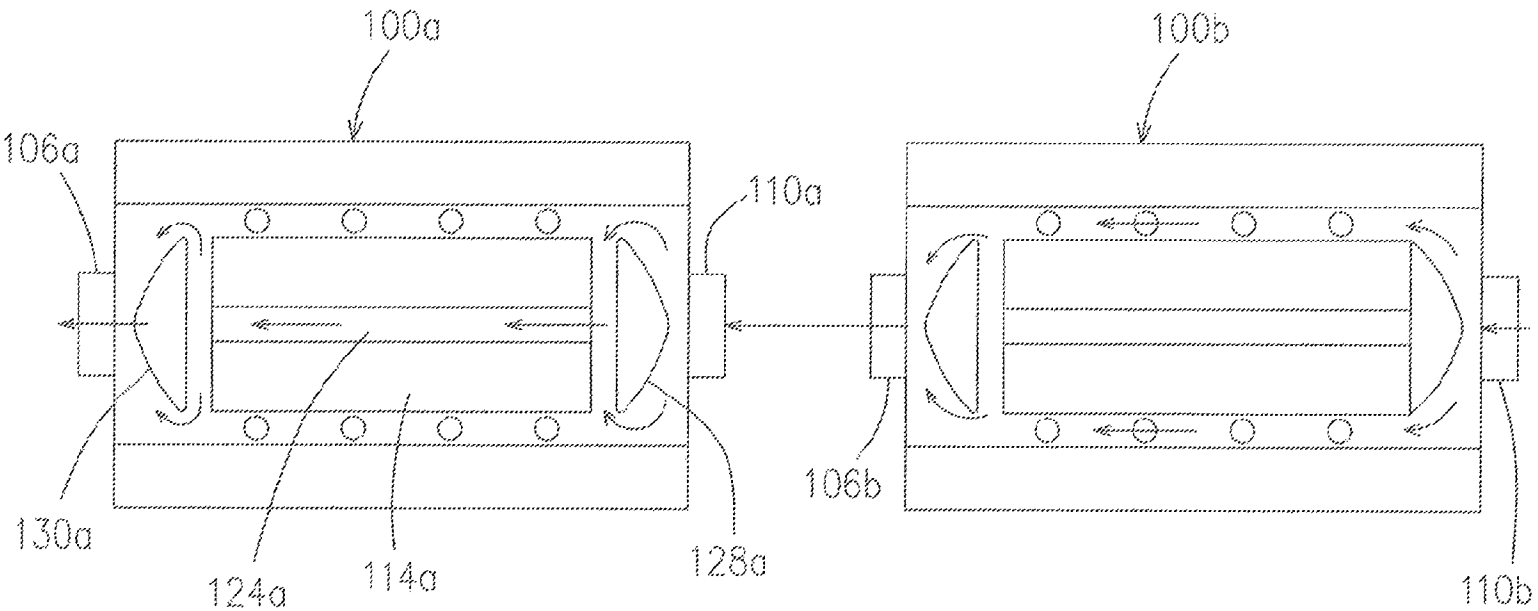
FIG. 5 is a schematic illustration of two pumps of the present invention connected in series.

In this embodiment, when the rotor 114 moves axially from adjacent the inlet core member 128 (i.e. as shown in FIGS. 1 and 2) towards the outlet core member 130, a gap opens between the rotor 114 and the inlet core member 128 (see FIG. 5). The central passage 125 of the rotor 114, the gap between the rotor 114 and the inlet core member 128 and the openings 142 in the outlet core member 130, therefore form a bypass assembly which will be discussed further below.

Referring again to FIGS. 1 and 2, casing 144 is provided around the housing 102 and the pump outlet 110, thereby forming a chamber 146 to accommodate a stator 148 therein. The casing 144 preferably includes an end wall 150 having a central opening (not indicated) for receiving the pump inlet 106. A mounting flange 152 is provided on the end wall 150. The casing 144 also has an open end closed by an end plate 154, which has a central opening for receiving the pump outlet 110, and is secured to the casing 144 by a retaining ring 156. The end plate 154 further includes inner and outer insert portions 158, 160 in cooperation with inner and outer retaining rings 162, 164 to restrain the axial position of the stator 148 in the annular coolant inlet openings 170 and flow through cooling passages 149 in the stator to cool the electrical winding, and then exit from the coolant outlet openings 168. As mentioned, preferably inlet openings 170 (adjacent the pump outlet end) are smaller than outlet openings 168 to "meter" oil into the cooling passages at the high pressure end of the pump while allowing relatively un-restricted re-entrance of the oil to the working conduit 104 via the larger holes of outlet openings 168.

The present invention permits operation at large speed range, including very high speeds (e.g. ++10,000 rpm), providing that Reynolds number is maintained below about 10,000 between rotor and conduit, and more preferably 5000 and still more preferably below about 2500, as mentioned above. High speeds can permit the device to be made considerably smaller than prior art pumps having similar flow rates and pressures. The construction also permits better reliability (simple design, no bearings) and tower operating costs than the prior art.

Pump 100 of the present invention includes parts which are relatively easy to manufacture. Where wires 126 are used as threads, they can be mounted to the cylindrical rotor 114 by winding them thereonto in a helix pattern, preferably in a pre-tensioned condition, and the rotor 114 is then inserted into the working conduit 104 to thereby provide a pumping chamber between the rotor and the housing, and the end caps are put into place. This method of providing helical threads can be broadly applied to other types of pumps, not only to electrically driven pumps.

In one aspect, the present invention also permits the problems associated with large pressure drops caused by an inoperative pump in a multiple pump system to be simply addressed, as will now be described.

FIG. 5 schematically illustrates two helix pumps 100*a* and 100*b* according to the present invention in series. When pump 100*a* is inoperative, the pressure differential across the inoperative pump 100*a* is reversed relative to operative pump 100*b* (i.e. the oil pressure at the inlet 110*a* is greater than at the outlet 106*a*). The rotor 114*a* is thus forced towards the outlet core member 130*a* and leaves a gap between the rotor 114*a* and the inlet core member 128*a*. Although the rotor 114*a* axially abuts the outlet core member 130*a*, the openings 142 (see FIG. 2) in the outlet core member 130*a* provide a passage from the central passage 125*a* to the pump outlet 106*a*. Therefore, in this case, oil pumped by the operative pump 100*b* enters the pump inlet 110*a* of the pump 100*a* and a major portion of the oil is permitted to flow through the bypass passage formed by the central passage 125*a* through the inoperative pump 100*a*, thereby significantly reducing the pressure drop that would otherwise occur across the inoperative pump 100*a*.

In another application of the present invention, the helix pump of the present invention can be used, for example, as a boost pump located upstream of a fuel pump in a fuel supply line, for example as may be useful in melting ice particles which may form in the fuel in low temperatures. The viscous shear force generated by the pump of the present invention to move the working liquid, also results in heat energy which can be used to melt any ice particles in the fuel flow.

Figure 6:
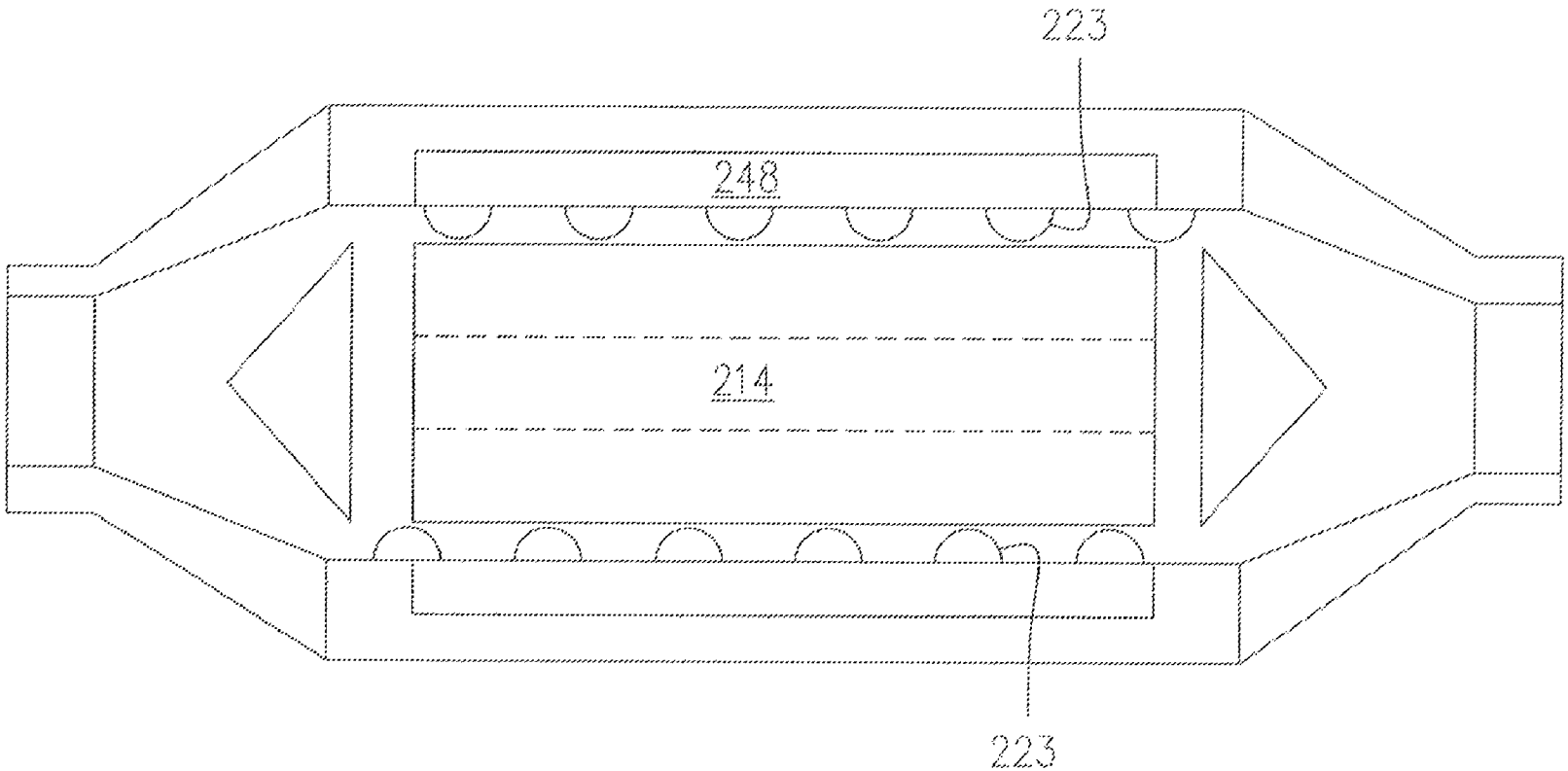
FIG. 6 is another embodiment according to the present invention.

It should be noted that modification of the described embodiments is possible without departing from the present teachings. For example, the invention may be used wherein the thread(s) is/are statically mounted to the stator, and a simple cylindrical rotor rotates therein, as depicted in FIG. 6, where elements analogous to those described above have similar reference numerals but are incremented by 200. Any other suitable combination or subcombination may be used. Also, the working medium may be any suitable liquid, such as fuel, water, etc. It should also be noted that the present concept may be applied to mechanically, hydraulically and pneumatically driven pumps, etc. The inoperative pump bypass feature is likewise applicable to other types of pumps, such as screw pumps, centrifugal pumps, etc. The bypass feature may be provided in a variety of configurations, and need not conform to the exemplary one described. Also, the pumped-medium stator cooling technique is applicable to other electrically driven pumps and fluid devices. Any suitable rotor and stator configuration may be used, and a permanent magnet and/or AC design is not required. The invention may be adapted to have an inside stator and outside rotor. Rounded surface 127 may have any radius or combination of multiple or compound radii, and may include flat or unrounded portions. The pressure feedback apparatus and bypass apparatus need not be provided by the same means, nor need they be provided in the rotor, not centrally in the rotor. The pump chamber(s) may have any suitable configuration: the inlets and outlets need not be axially aligned or concentrically aligned; the pumping chamber need not be a constant radius or annular; axial pumping may be replaced with centrifugal or other radial confirmation; the threads may not be continuous along the length of the rotor, but rather may be discontinuous with interlaced vanes; the threads may not be continuously helical; and still further modification will be apparent to the skilled reader and those listed here are not intended to be exhaustive. The scope of the present invention, rather, is intended to be limited solely by the scope of the claims.

The invention claimed is:

1. A pump for moving a liquid, the pump comprising an electric motor having a stator and magnetic rotor, the stator including at least one electric winding adapted, in use, to generate a rotating electromagnetic field, the rotor mounted adjacent the stator for rotation about an axis in response to the rotating electromagnetic field, the rotor and stator providing first and second spaced-apart surfaces defining a pumping passage therebetween, the pumping passage having an inlet at one axial end of the rotor and an outlet at another axial end of the rotor; and at least one helical thread disposed between the first and second surfaces and mounted to one of said surfaces, the thread when viewed in a cross section taken substantially parallel to the rotor axis having a rounded surface facing the other of said surfaces, wherein the rotor is sized relative to a selected working liquid such that, in use, the rotor in rotation is radially supported relative to the stator substantially only by a layer of the liquid maintained between the rotor and stator by rotor rotation.

2. The pump as defined in claim 1 wherein the rotor is a permanent magnet rotor.

3. The pump as defined in claim 1 wherein the at least one helical thread is mounted to the surface of the rotor.

4. The pump as defined in claim 1 wherein the at least one helical thread comprises three helical threads.

5. The pump as defined in claim 4 wherein the three helical threads are circumferentially spaced apart 120° from each other.

6. The pump as defined in claim 1 wherein the rounded surface has a radius of at least 0.008".

* * * * *